US011578483B2

(12) United States Patent
Schoenhard

(10) Patent No.: US 11,578,483 B2
(45) Date of Patent: Feb. 14, 2023

(54) WALL ASSEMBLY

(71) Applicant: G. David Schoenhard, Nar, PA (US)

(72) Inventor: G. David Schoenhard, Nar, PA (US)

(73) Assignee: Back-Lattice Wall Systems, LLC, Narberth, PA (US)

( * ) Notice: Subject to any disclaimer, the term of this patent is extended or adjusted under 35 U.S.C. 154(b) by 0 days.

(21) Appl. No.: 17/658,063

(22) Filed: Apr. 5, 2022

(65) Prior Publication Data

US 2022/0349175 A1 Nov. 3, 2022

Related U.S. Application Data

(60) Provisional application No. 63/201,431, filed on Apr. 29, 2021.

(51) Int. Cl.

| | |
|---|---|
| ***E04B 1/76*** | (2006.01) |
| ***E04B 1/66*** | (2006.01) |
| ***E04B 2/58*** | (2006.01) |
| ***E04B 2/74*** | (2006.01) |
| *E04B 1/24* | (2006.01) |

(52) U.S. Cl.

CPC ..... *E04B 1/7654* (2013.01); *E04B 1/66* (2013.01); *E04B 1/76* (2013.01); *E04B 1/7604* (2013.01); *E04B 1/7608* (2013.01); *E04B 2/58* (2013.01); *E04B 2/7412* (2013.01); *E04B 2001/2481* (2013.01); *E04B 2001/7679* (2013.01)

(58) Field of Classification Search

CPC . E04B 1/7654; E04B 1/66; E04B 1/76; E04B 1/7604; E04B 1/7608; E04B 2/58; E04B 2/7412; E04B 2001/2481; E04B 2001/7679

See application file for complete search history.

(56) References Cited

U.S. PATENT DOCUMENTS

| | | | | |
|---|---|---|---|---|
| 5,079,884 | A * | 1/1992 | Menchetti | E04C 3/32 52/579 |
| 5,440,854 | A * | 8/1995 | Hohmann | E04B 1/4178 52/489.1 |
| 6,164,028 | A * | 12/2000 | Hughes | E04B 2/764 52/855 |
| 6,279,284 | B1 * | 8/2001 | Moras | E04F 13/007 52/483.1 |
| 6,745,531 | B1 * | 6/2004 | Egan | E04F 13/042 52/302.1 |
| 8,429,866 | B2 * | 4/2013 | Knight | E04B 2/58 52/506.03 |
| 8,966,845 | B1 * | 3/2015 | Ciuperca | E04B 2/56 52/309.12 |
| 9,512,621 | B1 * | 12/2016 | Trezza | E04F 13/0875 |
| 9,856,655 | B2 * | 1/2018 | Knight | E04F 13/0862 |
| 10,774,526 | B1 * | 9/2020 | Kenyon, III | E04B 2/28 |
| 10,995,497 | B1 * | 5/2021 | Horne | E04D 1/34 |

(Continued)

*Primary Examiner* — Jessie T Fonseca

(74) *Attorney, Agent, or Firm* — Slavitt IP Law, LLC

(57) ABSTRACT

The present invention is directed to a wall assembly comprising a novel structural lattice frame comprising vertical studs and outwardly located horizontal furring spaced with thermal isolation pads therebetween at the framing intersections, foam insulation encapsulating the furring and at least a portion of the vertical studs, and an exterior air- and water-resistant barrier-protected sheathing fastened to the outward side of the horizontal furring.

20 Claims, 4 Drawing Sheets

(56) References Cited

U.S. PATENT DOCUMENTS

| | | | | |
|---|---|---|---|---|
| 2003/0070367 | A1* | 4/2003 | Gelin | E04B 2/7412 52/144 |
| 2004/0128930 | A1* | 7/2004 | Ohnishi | E04B 1/78 52/474 |
| 2006/0096201 | A1* | 5/2006 | Daudet | E04C 3/07 52/272 |
| 2007/0074474 | A1* | 4/2007 | Jannelle | E04B 1/7604 52/309.4 |
| 2007/0261348 | A1* | 11/2007 | Surowiecki | E04F 13/081 52/506.06 |
| 2010/0223870 | A1* | 9/2010 | Betts | B32B 7/12 427/446 |
| 2011/0296781 | A1* | 12/2011 | McGary | E04C 2/292 52/302.1 |
| 2012/0159885 | A1* | 6/2012 | Oberg | E04B 2/58 52/404.3 |
| 2012/0174503 | A1* | 7/2012 | Milostic | E04B 2/7409 52/480 |
| 2013/0305643 | A1* | 11/2013 | Singleton | G06F 30/13 52/404.1 |
| 2014/0250811 | A1* | 9/2014 | Krause | E04C 2/46 52/309.4 |
| 2017/0159293 | A1* | 6/2017 | Haley | E04F 13/0803 |
| 2017/0342723 | A1* | 11/2017 | Krause | E04B 1/40 |
| 2017/0370096 | A1* | 12/2017 | Ochi | E04F 13/147 |
| 2018/0148924 | A1* | 5/2018 | Krause | E04F 13/12 |
| 2018/0282998 | A1* | 10/2018 | Wang | E04D 13/1662 |
| 2018/0371748 | A1* | 12/2018 | Klein | B32B 9/046 |
| 2019/0078335 | A1* | 3/2019 | Kaligian, II | E04F 13/0803 |

* cited by examiner

WALL ASSEMBLY

CROSS REFERENCE TO RELATED APPLICATION

This application claims the benefit of the filing date of U.S. Provisional Application Ser. No. 63/201,431, filed on Apr. 29, 2021.

FIELD OF THE INVENTION

The present invention relates generally to a method of making a wall assembly and the wall assembly fabricated by such a method.

BACKGROUND OF THE INVENTION

Conventional structural steel wall framing assemblies locate vertical studs immediately inward of the exterior wall sheathing panels with a stud spacing that is driven by the attachment requirements of the wall sheathing as well as structural needs. In conventionally framed wall assemblies, fasteners project inwardly though multiple layers to fasten into the structural steel studs. This results in thermal bridging at each fastener. In such conventional steel stud wall assembly, sheathing panels are directly applied to vertical studs that are spaced to provide for bracing and secure attachment of the sheathing panels.

Conventional wall assemblies also typically provide horizontal or vertical zee or hat channel furring to receive the cladding and continuous insulation which is located outward of the sheathing and fastened directly back through the sheathing to the structural vertical studs. This configuration results in thermal bridging at the fasteners, additional construction steps required on the exterior side of the wall, warm-season condensation wetting the outward insulation, and additional risks of air and water leakage.

Energy codes require continuous insulation with minimal thermal bridging. Typically, continuous insulation is integrated with the exterior cladding support system on the outward side of the sheathing. The remainder of the total required insulation is then located between the studs on the inward side of the sheathing panels. This configuration can result in the exterior-side continuous insulation being adversely impacted by indirect weather exposure of incidental rainwater, condensation, and atmospheric dirt. This can also result in thermal bridging where the cladding systems penetrate the continuous thermal insulation.

SUMMARY OF THE INVENTION

The wall assembly of the present invention comprises a novel structural lattice frame located inward of the sheathing comprising vertical studs and outwardly located horizontal furring having thermal isolation pads at the framing intersections and an exterior air- and water-resistant barrier-protected sheathing fastened to the outward side of the horizontal furring. The wall assembly is capable of accommodating the application of a continuous layer of closed-cell spray polyurethane foam insulation located entirely on the inward side of the sheathing to encapsulate and isolate the structural lattice frame from the exterior sheathing.

BRIEF DESCRIPTION OF THE DRAWINGS

A fuller understanding of the invention can be gained from the following description of certain embodiments of the invention when read in conjunction with the accompanying drawings in which.

DETAILED DESCRIPTION OF THE INVENTION

Figure 1:
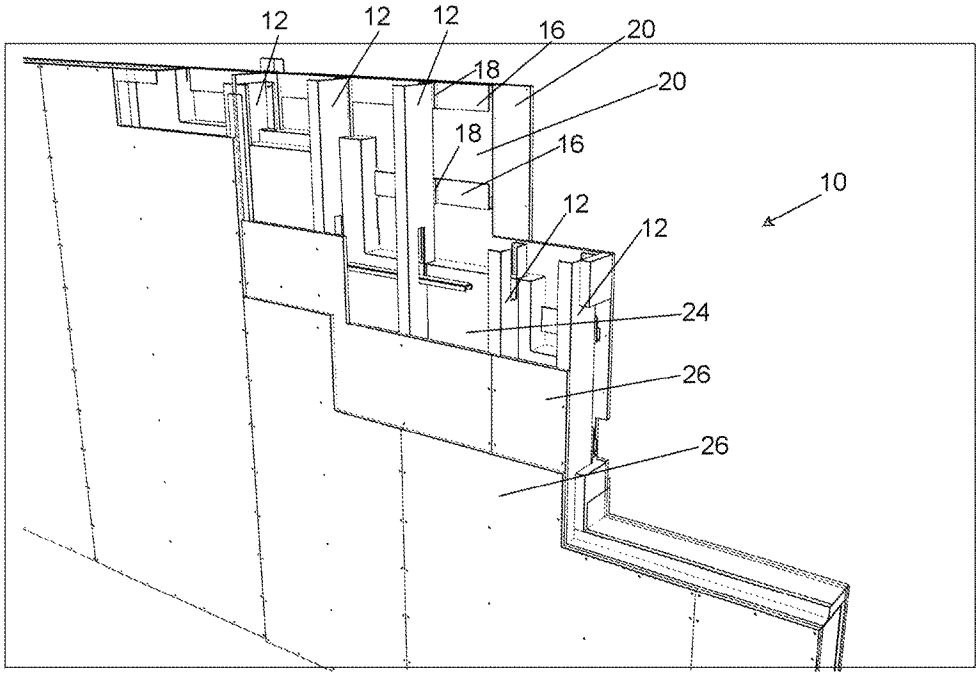
FIG. 1 depicts a cutaway of one embodiment of the various components described herein as viewed from the interior side.

In one embodiment, the structural lattice frame comprises galvanized steel vertical studs, and horizontal furring preferably light-gauge steel, to which the sheathing is directly applied on the exterior side thereof. In this embodiment, the vertical studs and horizontal furring are separated at each intersection with a thermal isolation pad.

This open-lattice framing allows for the application of a continuous layer of closed-cell spray foam that encapsulates the framing members and provides for continuous and total insulation as well as additional air barrier and Class 2 bi-directional vapor control located completely on the inward side of the sheathing. The wall assembly of the present invention also allows for incremental fastening and encapsulation of the fastener shanks which significantly reduces thermal bridging risks, such as condensation formation. The framing arrangement may utilize separate fasteners at each layer, and the continuous layer of closed-cell foam insulation further reduces thermal transfer at the fastener points.

In certain embodiments, ⅝" glass-mat, preferably mold-resistant, and fire-rated exterior gypsum sheathing panels may be applied and fastened to the horizontal furring in either one or two layers based on the fire-rated wall assembly. The furring is sized and spaced to brace and accept the attachments of the sheathing as well as exterior rainscreen cladding. The horizontal furring, which is located inward of the sheathing, also allows for the variable left and right location of attachments of the exterior claddings independently of the vertical stud locations. The horizontal furring may be customized to accommodate the unique needs of the cladding attachments. This effectively decouples the locations of the studs from the attachment points of the cladding. Accordingly, the vertical studs located interior to the horizontal furring are able to serve solely as structural elements independent of requirements relating to the application of sheathing panels.

The wall assembly of the present invention locates the horizontal furring on the inward side of the sheathing, and provides for the entire continuous insulation layer to be positioned inward of the sheathing. Because of the thermally isolated structural lattice framing, the continuous insulation layer can encapsulate the structural framing and isolate the vertical studs from the sheathing while also encapsulating the horizontal furring. Even at the narrowest framing intersections, the approximately R1.55 thermal isolation pads are not considered a thermal break.

The wall assembly of the present invention also allows the exterior-side construction steps to be reduced. Because the horizontal furring and the continuous insulation layer are located inward of the air and water-resistant protected sheathing, the exterior-side construction steps are reduced to installing flashings and windows, performing quality control testing, and applying the finished rain-screen cladding systems.

The wall assembly of the present invention is well suited to pre-fabrication or panelization. Once the wall assembly is coated on the exterior or outward side with the air and water-resistant barrier, and a spray foam insulation layer is applied to the inward, the wall assembly is functionally complete except for final flashings, claddings, and window openings. Not only does this reduce the number of in-field exterior construction steps, it also assures closer quality control of each of the factory-performed assembly steps, and reduces weather dependence. The wall assembly is also capable of maintaining a compact form and thus is more efficient to ship. It is also possible to include the exterior cladding system with the prefabricated wall panel assembly and to apply the spray foam insulation at the construction site.

The air and water-resistant barrier applied to a wall is the primary defense against air and water infiltration into the building. This barrier is typically located behind the rainscreen cladding systems. In many traditional cladding systems, multiple assembly components are applied exterior of the air and water-resistant barrier. The addition of each wall assembly component, however, risks damaging or causing a leak in the air and water-resistant barrier. Each additional wall assembly component also presents challenges for quality control testing to assess, locate, and remediate any problems. The wall assembly of the present invention presents to the exterior the minimum of components (i.e., in a "naked" condition) thus allowing efficient quality control validation and identification for remediation should a problem be identified. Once windows and openings are installed and flashed, and cladding support tracks are installed, the exterior side of the wall assembly requires no further penetrations, and thus can be efficiently quality-control tested. Testing prior to the application of the rainscreen cladding is recommended to identify, locate, and remediate any problems most efficiently.

While the traditional wall assemblies separately address each required element of building and energy codes, the wall assembly of the present invention integrates these elements. The spray foam insulation is itself a complete, continuous, and sufficient insulation layer which meets applicable energy codes. The air and water-resistant coating applied to the sheathing provides the required water-resistant barrier as well as the required air barrier. The foam insulation layer also provides an additional air barrier, and serves as a bi-directional Class-2 vapor retarder to both the exterior and the interior without the risk of causing competing double vapor retarders. Due to the integrated advantages of the wall assembly of the present invention, the completed wall can utilize lightweight exterior non-combustible claddings and interior gypsum drywall that is NFPA 285 compliant for vertical and lateral fire propagation. The wall assembly can also be readily adapted to meet various degrees of fire-resistance and load-bearing capabilities up to 2 hour rated, load-bearing, from both the interior and exterior exposure.

The wall assembly of the present invention can be constructed to accommodate a variety of architectural requirements. In addition to being constructed into square and rectangular panels, the wall assembly of the present invention can be extended to angular and curvilinear surfaces. These forms may require the addition of supplementary structural supports and/or struts. For curvilinear forms, rolled framing and flexible sheathing such as wire lath and cement plaster may also be required.

In certain embodiments, the vertical studs may comprise new or existing studs, and may be formed from steel, including galvanized steel. The studs may be designed for supporting vertical loading and accepting the vertical and horizontal loading of the horizontal hat channel furring and its associated vertical and horizontal inward and outward loadings consistent with code and industry standards. In one embodiment, the studs may comprise 20, 18, 16, or 14 gauge G60 or G90 galvanized steel and may be arranged in the wall assembly with a minimum depth of 3⅝" and a maximum spacing of 24", and typically 6" deep with lateral and/or diagonal bracing may also be used on the outward side of the studs or fastened through the stud cutouts. In one embodiment, the studs have a minimum flange width of 2" in order to support one or more similarly sized insulation pads.

In certain embodiments, the horizontal furring may comprise back-furring or sub-girt framing. In such embodiments, sub-girt framing may be constructed directly outward of the studs atop the thermal isolators, or a sub-girt frame may be separately prefabricated and then applied atop the prefabricated stud frame with the thermal isolators separating the two. In certain embodiments, the sub-girt framing has a thickness of about 1". When mounted on studs with ½"-thick thermal isolation pads positioned at the connection points between the sub-girt framing and the vertical studs, there is a 1½" separation between the outward side of the vertical stud to the inward side of the exterior sheathing. This gap may be filled with closed-cell spray foam and maintain lateral fire-blocking within the wall's cavity spaces. In certain embodiments, the sub-girt framing has a face width of approximately 1⅝" to 1¾" in order to accommodate the joining of two sheathing panel joints each with a screw fastener-to-panel edge distance of ½" in addition to reasonable construction tolerance. This face width may also be increased to support the unique requirements of the wall-cladding attachments.

In certain embodiments, the horizontal furring may be Z-shaped and formed from steel, including galvanized steel, and is located inward of the exterior sheathing and outward of the vertical studs and thermal isolation pads. The Z-shaped horizontal furring is designed for supporting wind loading and for attachment of the cladding systems and the exterior sheathing panels consistent with code and industry standards. In one embodiment, the Z-shaped horizontal furring may comprise 20, 18, 16 or 14 gauge G60 or G90 galvanized steel and may be arranged in the wall assembly with a minimum depth of about 1" or a maximum depth of about 1½". In one embodiment, a front leg of 1⅝" to 1¾" is provided to accommodate a horizontal gypsum sheathing panel joint with a ½" setback for the edge fasteners in each panel.

In certain embodiments, the Z-shaped horizontal furring may employ 16" vertical spacing, and spacing may be increased up to 24" or decreased to 12". The Z-shaped horizontal furring may be affixed to each vertical stud by means of one or more #12 galvanized steel or stainless steel fastener located through the long-legged flange. In certain embodiments, J-shaped horizontal furring may be used at the top and bottom of wall panel edges. In such embodiments, J-shaped furring is used to support the outer edge of an exterior sheathing panel. In certain embodiments, vertical L-framing angles of 20 gauge or 18 gauge may be used at vertical panel edges by fastening atop the horizontal furring to support the outer edge of an exterior sheathing panel between the furring supports. In one embodiment, L-framing supports are sized to hold a gap of ¼" away from the vertical steel stud to avoid thermal bridging. Self-adhesive flashing tape may be applied to the ¼" to ½" gap in order to contain the spray insulation.

In certain embodiments, diagonal bracing is accomplished by flat strapping applied to the outward side of the studs. In such embodiments, such bracing is designed for supporting various loadings in accordance with code and industry standards.

Thermal isolation pads may be located between each stud and furring intersection. In certain embodiments, the thermal isolation pads may be formed from high density (HD) polyurethane capable of accommodating the structural loadings. In certain embodiments, the thermal isolation pads may be rectangularly shaped and may be oriented vertically atop the outward flange of the vertical steel stud. In certain embodiments, the thermal isolation pads may be provided in continuous strips. In certain embodiments, the thermal isolation pads may be about 8' long or cut or broken into lengths of at least 6" long, about 2" wide, and about ½" thick. In certain embodiments, the thermal isolation pads may have a minimum compressive strength of about 560 psi. In certain embodiments, the thermal isolation pads may have an R-value of R1.55 minimum. In certain embodiments, the #12 structural fasteners may bridge and support the framing components even if the thermal isolation pads char and shrink in a fire exposure condition.

Sheathing panels may be selected for any combination of wind resistance, fire resistance, and durability. The sheathing panels may be applied in one or two-layer thickness based upon the fire-rated assembly. In certain embodiments, the sheathing panels comprise ⅝" fiberglass reinforced, preferably mold-resistant, gypsum, and fire-rated. In certain embodiments, the sheathing panels are affixed to the furring by means of galvanized steel or stainless steel fasteners in accordance with code and industry standards. When a fire-rated assembly, the sheathing is always applied horizontally. Otherwise, the sheathing may be applied vertically or horizontally. In certain embodiments, a minimum separation gap of about 1½" is maintained between the inward side of the sheathing and the outward face of the vertical studs. The separation gap may be as much as about 2⅛" if 1½" horizontal furring is used, but may require additional lateral fire stopping.

A continuous layer of spray foam insulation may be applied to the inward side of the exterior sheathing. In certain embodiments, the spray foam insulation is Class A, 2-lb. density closed-cell polyurethane foam having a flame spread index of 25 or less and a smoke-developed index of 450 or less. In certain embodiments, the spray foam insulation has a minimum total insulation value of R21, and a minimum continuous insulation value of R10. In certain embodiments, the spray foam insulation may be either spray applied or pour-filled directly to the inward side of the sheathing to achieve the design thickness to meet the total needs of the continuous and total insulation as based on the standard energy codes applicable to climate zones 1 through 8. The spray foam insulation may be applied in one pass or preferably in multiple passes, with the first pass addressing the perimeters, then the next pass on basic thickness, then the final pass on touch-ups and infilling low spots. When applied, the spray foam insulation fully extends behind the outward side of the vertical studs and within the belly of the horizontal furring so that the outward side flange of the vertical studs and the entire furring are fully encased. In certain embodiments, the spray foam insulation has a minimum thickness of about 1½" in order to provide a sufficient air barrier and a Class 2 vapor barrier. In such embodiments, the closed-cell nature of the spray foam insulation functions from bi-directional vapor drive with no zone for vapor collection within the body of the closed-cell foam.

In certain embodiments, the remaining stud cavity space may optionally be filled with R.15 3½" unfaced mineral wool batt friction-fit insulation of approximately 2 lb density to either provide additional supplemental insulation and/or to provide additional thermal fire-protection in certain fire-rated wall assemblies. This embodiment can provide additional R-value of up to about a total of R39 for the entire wall assembly, and/or the increased requirements for fire-rated assemblies. In this embodiment, the mineral wool batt insulation may be friction fit between the studs, installed inward and tight against the spray foam, and held approximately ½" away from the outward side of the interior drywall.

In certain embodiments, an air- and water-resistant barrier is applied to the exterior sheathing panels. This barrier may be achieved by application of a fully adhered membrane or a fluid-applied membrane to the installed sheathing panels, or it may be pre-applied to sheathing panels prior to installation. In certain embodiments, the barrier is vapor permeable rated greater than about 10 perms. In certain embodiments, the air- and water-resistant barrier is coordinated with accessory panel joint sealants, fastener head cappings, control joint flashings, expansion joint flashings, window and door opening flashings, utility opening flashings, and/or building articulation corner and intersection flashings. In certain embodiments, such as when the exterior rainscreen cladding system will have open joints, UV-light tolerant coatings, flashings, and/or sealants may be applied.

In certain embodiments, one or more wall openings may be provided that penetrate the wall assembly. The sub-girt framing of a wall opening with J-shaped or L-shaped members can provide the structural integrity to such openings. The addition of fire-resistant materials such as a layer of the exterior sheathing, or exterior-grade fire-retardant wood or plywood, or cement board, can provide fire-resistance with only exterior-grade fire-retardant wood or plywood used in the window sill due to it needing to be able to bear the weight of the window systems.

In certain embodiments, exterior rainscreen treated, mineral wool rigid insulation of approximately 1" thick, of approximately 8 lb density, unfaced, may be mechanically fastened to the outward side of the air- and weather-barrier protected sheathing. This mineral wool rigid insulation provides additional insulation and/or additional thermal fire-protection in certain fire-rated wall assemblies It is noted that this outward mineral wool insulation may collect condensation in warm seasons, but its primary purpose is as part of the 2-hour fire-rated wall assembly.

In certain embodiments, exterior-grade fire retardant blocking may be used to line jambs, sill, and head of wall openings including at doors and windows to close the furred-out zone to fire transmission. In certain embodiments, the fire-retardant blocking comprises 1½" exterior-grade, fire-retardant treated kiln-dried wood, or ¾" exterior-grade fire-retardant treated, kiln-dried structural plywood sheathing. In such embodiments, the blocking may be structurally secured with galvanized steel or stainless steel fasteners affixed to the steel sub-framing. The blocking may be covered with flexible flashing towards the opening and onto the outer side of the sheathing.

In certain embodiments, gypsum drywall may be applied to the interior side of the wall panel assembly. The interior gypsum drywall panels are applied in one or two-layer thickness based upon the fire-rated assembly. In a fire-rated assembly the gypsum panels are always applied vertically, when not fire-rated, they may be applied vertically or horizontally. In such embodiments, the gypsum drywall provides thermal protection of the spray foam insulation. In certain embodiments, the thickness and joint treatment of the gypsum drywall complies with NFPA 285 assembly requirements and fire-rated wall assembly requirements.

In certain embodiments, exterior cladding and a cladding support system is provided. In such embodiments, the exterior cladding may provide exterior ignition protection, wind and rain protection for the wall assembly, and UV-light protection for the concealed wall components. Preferably, the exterior cladding and cladding support system complies with NFPA 285 assembly requirements as well as applicable building and fire codes.

Figure 2:
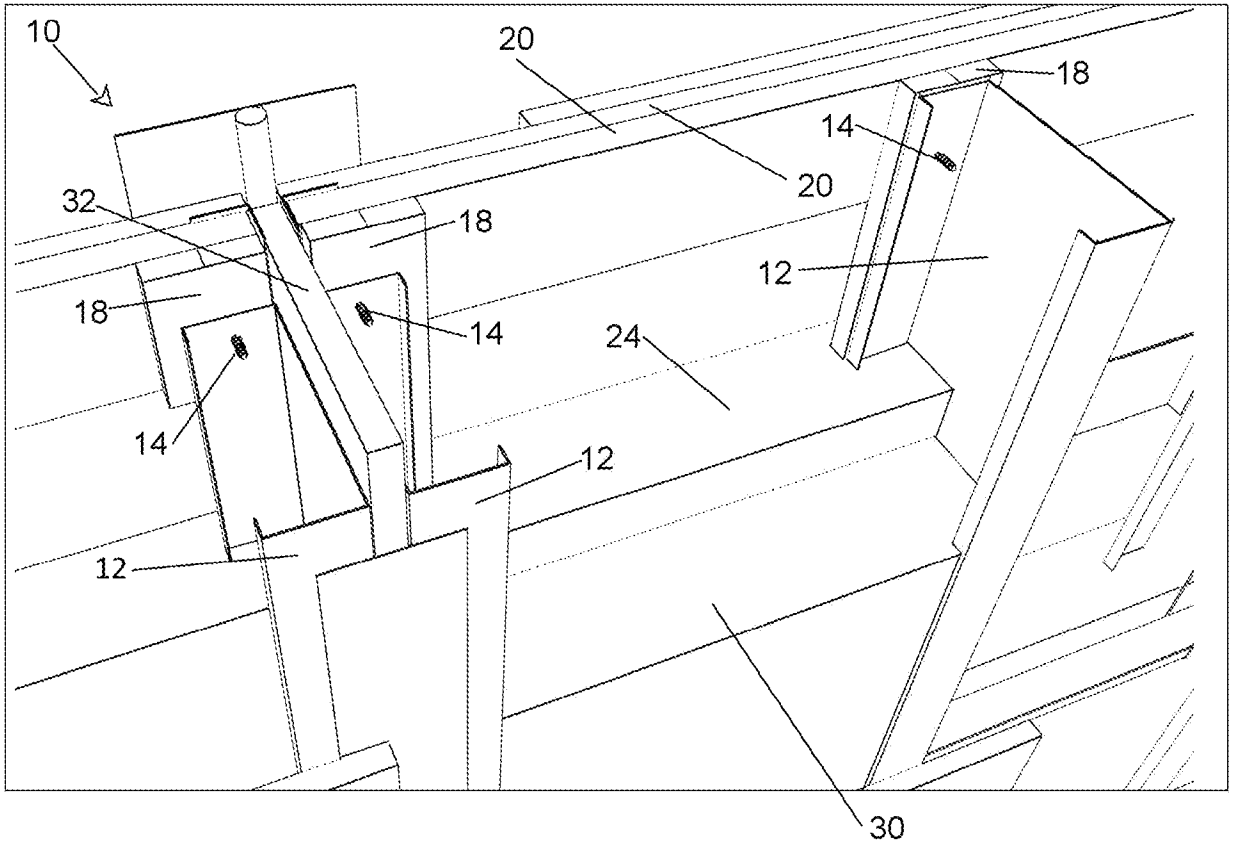
FIG. 2 depicts a different perspective of the embodiment of FIG. 1 also as viewed from the interior side.
Figure 3:
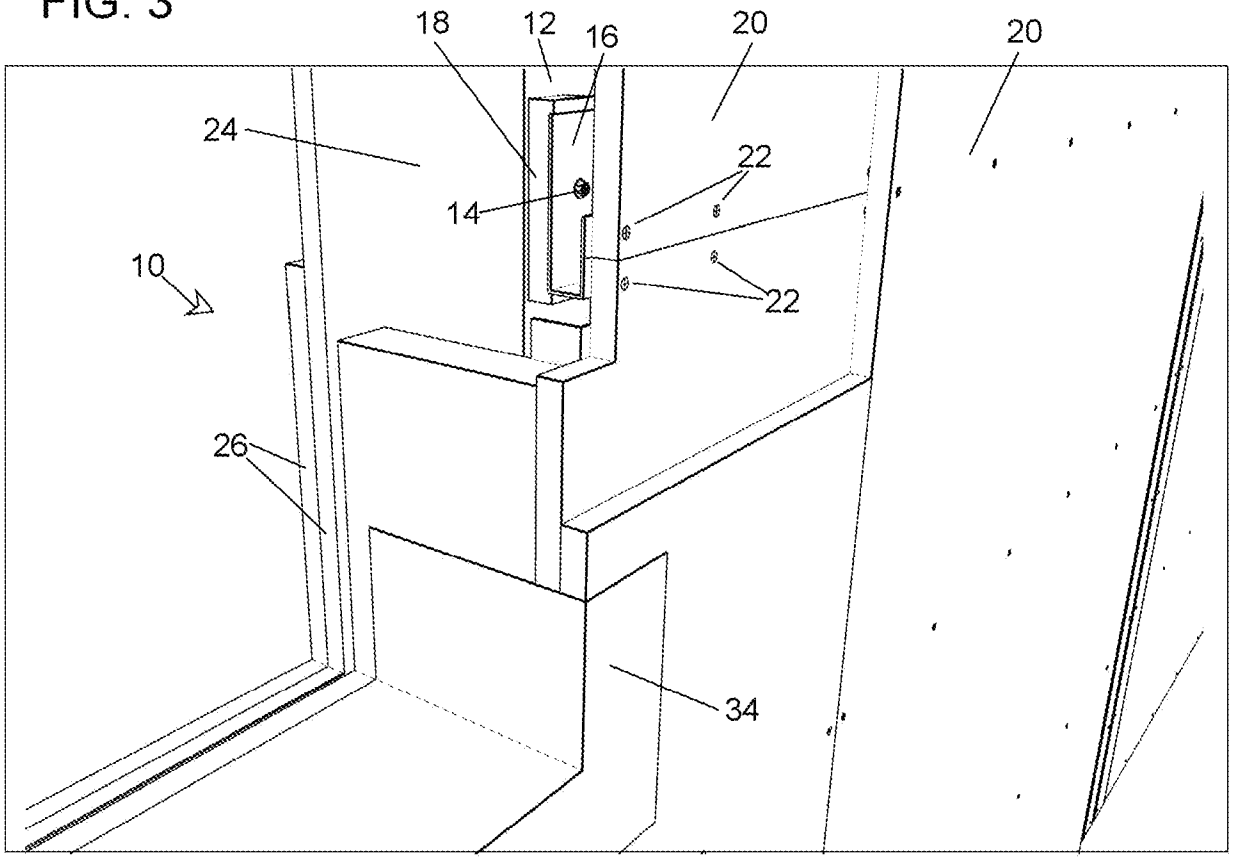
FIG. 3 depicts a cutaway of the embodiment of FIG. 1 as viewed from the exterior side.
Figure 4:
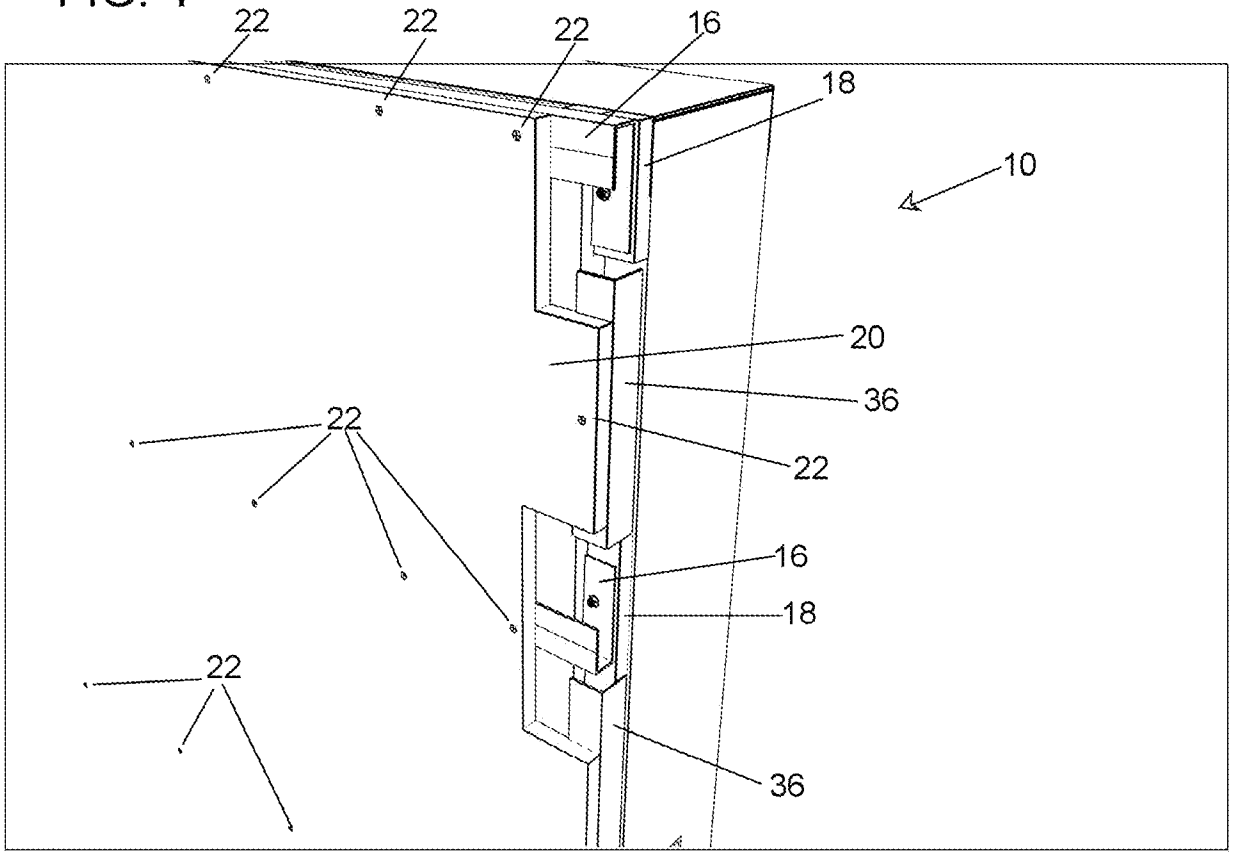
FIG. 4 depicts a different perspective of the embodiment of FIG. 1 also as viewed from the exterior side.

With reference to the embodiments depicted in FIGS. 1-4, the wall assembly 10 comprises a lattice frame of vertical studs 12 attached by means of fasteners 14 to outwardly located Z-shaped horizontal furring 16 having thermal isolation pads 18 at the framing intersections and an exterior air- and water-resistant membrane-protected sheathing 20 fastened to the outward side of the horizontal furring by means of fasteners 22. The wall assembly also includes a continuous layer of closed-cell spray foam insulation 24 located entirely on the inward side of the sheathing 20 to encapsulate and isolate the structural lattice frame of vertical studs 12 and outwardly located Z-shaped horizontal furring 16 from the exterior sheathing 20. Gypsum drywall 26 may be applied to the interior side of the wall panel assembly by means of fasteners 28. As shown in FIG. 2, the remaining stud cavity space may optionally be filled with mineral wool batt friction-fit insulation 30, and joints between vertical studs 12 can be filled with 4 # mineral wool compressed 50% filler 32. As shown in FIG. 3, flashing 34 may be provided at openings such as window and door openings. As shown in FIG. 4, the wall assembly may also be provided with L-shaped framing angles along vertical edges 36. In another embodiment, the wall assembly may be provided with J-shaped horizontal furring at top and bottom horizontal edges, and may be used as an option along vertical edges to facilitate sub-framing prefabrication.

The wall assembly of the present invention demonstrates superior fire resistance. The wall assembly of the present invention was ASTM E119 tested with 2-hour exterior exposure fully load-bearing to 100% capacity. It was also ASTM E119 tested with 2-hour interior exposure fully load-bearing to 80% capacity. The wall assembly of the present invention was also interior and exterior ASTM E119 tested with 1-hour exposure to 80% capacity. The wall assembly of the present invention is also compliant with NFPA 285.

While specific embodiments of the invention have been described in detail, it will be appreciated by those skilled in the art that various modifications and alternatives to those details may be developed in light of the overall teachings of the disclosure. Accordingly, the particular arrangements disclosed are meant to be illustrative only and not limiting as to the scope of the invention which is to be given its full breadth. Therefore, any of the features and/or elements which are described above may be combined with one another in any combination and still be within the breadth of this disclosure.

I claim:

1. A prefabricated wall assembly for construction of a wall, comprising:

a plurality of spaced vertical studs each having an inward side and an outward side;

a plurality of spaced horizontal furring strips each having an inward side and an outward side, wherein the inward sides of the horizontal furring strips are fastened to the outward sides of the plurality of vertical studs to form a structural lattice frame having an intersection at each point of attachment between the plurality of horizontal furring strips and the plurality of vertical studs;

a plurality of thermal isolation pads, wherein the pads are positioned between the vertical studs and the horizontal furring strips at the points of attachment;

exterior sheathing having an inward side and an outward side, wherein the inward side of the sheathing is fastened to the outward side of the horizontal furring strips; and a continuous layer of closed-cell spray foam insulation located entirely on the inward side of the sheathing, wherein the insulation encapsulates the structural lattice frame and thermally isolates the vertical studs from the sheathing.

2. The wall assembly of claim 1, wherein the vertical studs comprise 12 to 20 gauge galvanized steel and wherein the outward side of each vertical stud comprises a flange.

3. The wall assembly of claim 1, wherein the horizontal furring strips have long axis and a J-shaped or Z-shaped cross section perpendicular to the long axis.

4. The wall assembly of claim 1, wherein the horizontal furring strips are fastened to the vertical studs by a first plurality of fasteners and the sheathing is fastened to the horizontal furring strips by a second plurality of fasteners, and wherein the first plurality of fasteners are separate from the second plurality of fasteners.

5. The wall assembly of claim 4, wherein the locations of the first plurality of fasteners are different from and independent of the locations of the second plurality of fasteners.

6. The wall assembly of claim 1, wherein the sheathing is coated with an air and water-resistant barrier.

7. The wall assembly of claim 6, wherein the air and water-resistant barrier comprises a coating applied to the outward side of the sheathing.

8. The wall assembly of claim 1, further comprising rainscreen cladding secured to the outward side of the sheathing.

9. The wall assembly of claim 1, wherein the structural lattice frame comprises a rolled structural lattice frame and the sheathing comprises flexible sheathing.

10. The wall assembly of claim 1, further comprising gypsum drywall secured to the inward side of the vertical studs.

11. A method for fabricating a wall assembly, comprising the steps of:

providing a plurality of spaced vertical studs each having an inward side and an outward side, fastening a plurality of spaced horizontal furring strips each having an inward side and an outward side to the outward sides of the plurality of vertical studs to form a structural lattice frame having an intersection at each point of attachment with the plurality of vertical studs;

positioning a thermal isolation pad between each of the plurality of vertical studs and the plurality of horizontal furring strips at the intersections thereof;

fastening sheathing to the outward side of the horizontal furring strips; and applying a continuous layer of closed-cell spray foam insulation entirely on the inward side of the sheathing, wherein the insulation encapsulates the structural lattice frame and thermally isolates the vertical studs from the sheathing.

12. The method of claim 11, wherein the vertical studs comprise galvanized steel.

13. The method of claim 11, wherein the horizontal furring strips have a long axis and a J-shaped or Z-shaped cross section perpendicular to the long axis.

14. The method of claim 11, wherein the horizontal furring strips are fastened to the vertical studs by a first plurality of fasteners and the sheathing is fastened to the horizontal furring strips by a second plurality of fasteners, and wherein the first plurality of fasteners are separate from the second plurality of fasteners.

15. The method of claim 14, wherein the locations of the first plurality of fasteners are different from and independent of the locations of the second plurality of fasteners.

16. The method of claim 11, wherein the sheathing is coated with an air and water-resistant barrier.

17. The method of claim 16, wherein the air and water-resistant barrier comprises a coating applied to the outward side of the sheathing.

18. The method of claim 11, further comprising the step of securing rainscreen cladding to the outward side of the sheathing.

19. The method of claim 11, wherein the structural lattice frame comprises a rolled structural lattice frame and the sheathing comprises flexible sheathing.

20. The method of claim 11, further comprising the step of securing gypsum drywall to the inward side of the vertical studs.

* * * * *